US006567634B2

(12) United States Patent
Okamoto

(10) Patent No.: US 6,567,634 B2
(45) Date of Patent: May 20, 2003

(54) LIQUID RECOVERY METHOD AND APPARATUS

(75) Inventor: Masaya Okamoto, Niigata (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/848,100

(22) Filed: May 3, 2001

(65) Prior Publication Data

US 2001/0043821 A1 Nov. 22, 2001

(30) Foreign Application Priority Data

May 10, 2000 (JP) ..... 2000-137231

(51) Int. Cl.[7] ..... G03G 15/10
(52) U.S. Cl. ..... 399/249
(58) Field of Search ..... 399/57, 88, 233, 399/237, 249, 250, 251

(56) References Cited

U.S. PATENT DOCUMENTS 5,332,642 A * 7/1994 Simms et al. ..... 399/250 X
5,905,928 A * 5/1999 Shin ..... 399/250
5,940,666 A * 8/1999 Han ..... 399/249
5,999,775 A * 12/1999 Kim ..... 399/251 X
6,134,401 A * 10/2000 Yun et al. ..... 399/88 X
6,178,299 B1 * 1/2001 Kim ..... 399/88
6,195,514 B1 * 2/2001 Kim ..... 399/237 X
6,205,317 B1 * 3/2001 Song et al. ..... 399/249 X

FOREIGN PATENT DOCUMENTS

JP 8-166721 6/1996
JP 8-166722 6/1996

* cited by examiner

*Primary Examiner*—Sandra Brase
(74) *Attorney, Agent, or Firm*—Ostrolenk, Faber, Gerb & Soffen, LLP

(57) ABSTRACT

An electro-photographic image forming apparatus forms an electrostatic latent image on a photosensitive belt and develops the electrostatic latent image with liquid toner composed of particle toners and a liquid solvent. With absorption means, whose surface is a liquid-solvent absorption layer, in pressure contact with the photosensitive belt, only the liquid solvent is recovered from the liquid toner image developed on the photosensitive belt. A dried toner image is transferred from the photosensitive belt to paper to fix the toner image thereon. The absorption means is heated by a heat source controlled by a temperature control method, which differs between the standby time and the print time, to vaporize the liquid solvent absorbed in the absorption layer. In addition, the electro-photographic image forming apparatus has means for moistening all part of the absorption means with the liquid solvent before the first image is written on the photosensitive belt.

5 Claims, 6 Drawing Sheets

LIQUID RECOVERY METHOD AND APPARATUS

BACKGROUND OF THE INVENTION

1. Field of the Invention

The present invention relates to an electro-photographic image forming apparatus and an electro-photographic image forming method. More particularly, the present invention relates to an electro-photographic image forming apparatus and an electro-photographic image forming method that form a visualized image on a photosensitive body using a developer composed of a liquid solvent and a particle toner.

2. Description of the Related Art

A conventional image forming apparatus, which uses this type of electro-photographic recording technology, uses a liquid recovery unit to recover a liquid solvent from the developer and leaves only particle toners on the photosensitive body when the apparatus transfers an image from a photosensitive body onto paper.

In this case, to allow the image forming apparatus to increase the quality of an image to be transferred on paper and to reuse the liquid solvent, it is important to recover all liquid solvents.

For example, according to the art disclosed in Japanese Patent Laid-Open Publication No. Hei 8-166722, a suction fan sucks air from a solvent vapor recovery room, which is filled with solvent vapors and which is formed by having a fixing unit and a paper ejection unit covered by a covering member, via a first duct and a liquefier to recover the liquid solvent for smoothly recovering the solvent vapor.

Also, according to the art disclosed in Japanese Patent Laid-Open Publication No. Hei 8-166721, a solvent vapor is liquefied and the resulting liquid is collected in the liquid acceptor. The collected liquid is then separated into a solvent and water to increase the liquid solvent recovery efficiency.

However, the prior art described above does not disclose a method for recovering a liquid solvent from a developer when an image is transferred from the photosensitive body to paper.

Therefore, there is room for improvement in increasing the quality of printing onto paper. In addition, there is also room for improvement in prolonging the life of a desiccant that dries a liquid solvent into vapor.

SUMMARY OF THE INVENTION

It is an object of the present invention to prevent a drying belt from over-absorbing a liquid solvent when printing described above starts, to ensure good printing, and to prolong the life of the drying belt.

An electro-photographic image forming apparatus according to the present invention comprises a photosensitive belt; electrostatic latent image forming means for forming an electrostatic latent image on the photosensitive belt; as many developing means as are necessary for monochrome or multiple-color processing for developing the electrostatic latent image with a liquid toner composed of a particle toner and a liquid solvent; liquid recovery means for recovering only the liquid solvent from a liquid toner image developed on the photosensitive belt; and transfer/fixing means for taking a dried toner image from the photosensitive belt for transferring the toner image to, and fixing the toner image on, paper, wherein the liquid recovery means comprises absorption means that is brought into pressure contact with the photosensitive belt and that has an absorption layer absorbing the liquid solvent into a surface thereof; a heat source that vaporizes the liquid solvent absorbed in the absorption layer of the absorption means; and temperature control means for controlling a temperature of the heat source with a temperature control method that differs between a standby time and a print time.

In addition, the electro-photographic image forming apparatus according to the present invention further comprises means for moistening all of the absorption means with the liquid solvent before a first image is written on the photosensitive belt.

In addition, the means for moistening all of the absorption means with the liquid solvent has liquid supplying means that is separate from the developing means.

In addition, the electro-photographic image forming apparatus according to the present invention comprises an actuator that separates the absorption means from the photosensitive belt at the standby time and brings the absorption means into contact with the photosensitive belt and at the print time.

DETAILED DESCRIPTION OF THE PREFERRED EMBODIMENTS

The present invention will be described in detail by referring to the attached drawings.

Figure 1:
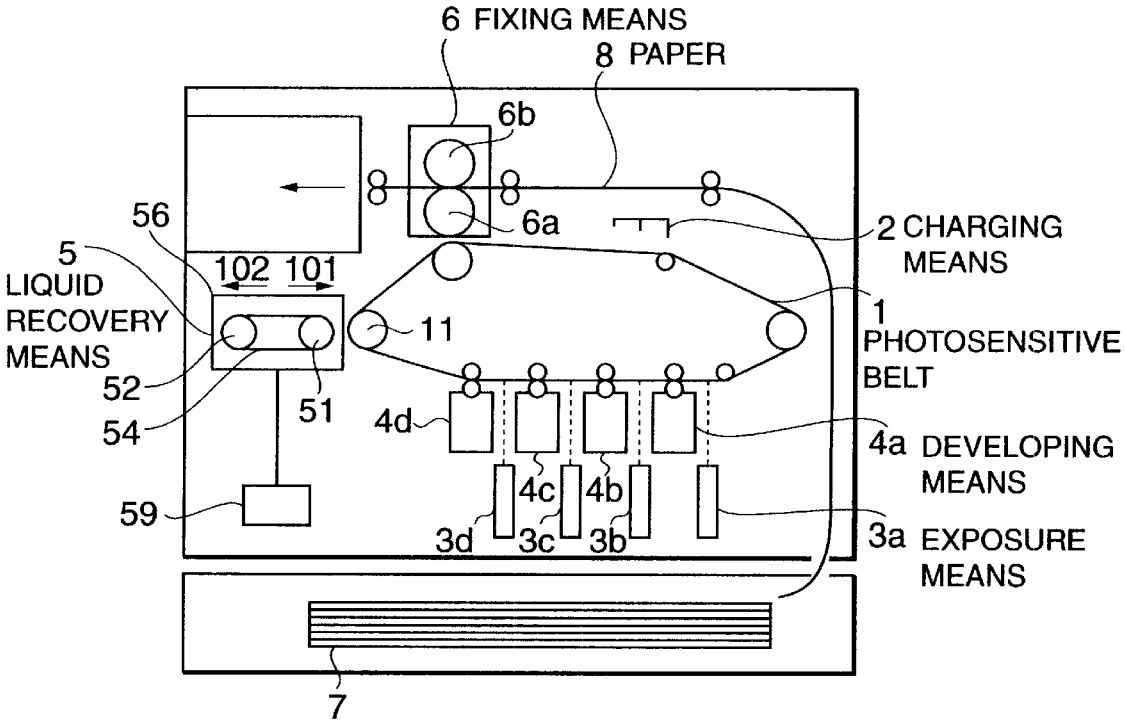
FIG. 1 is a diagram showing the configuration of a first embodiment of the present invention.

FIG. 1 is a diagram showing the configuration of a first embodiment of an electro-photographic image forming apparatus according to the present invention.

The electro-photographic image forming apparatus comprises a photosensitive belt 1, charging means 2, exposure means 3*a*, 3*b*, 3*c*, and 3*d*, developing means 4*a*, 4*b*, 4*c*, and 4*d*, liquid recovery means 5 comprising a nip roller 51, a drying belt 54, a cleaning roller 53, and a resin roller 52, and transfer/fixing means 6 comprising a transfer roller 6*a* and a fixing roller 6*b*.

The photosensitive belt 1, supported by a plurality of rollers, can rotate clockwise in FIG. 1.

The charging means 2 charges the surface of the photosensitive belt 1.

The exposure means 3*a*, 3*b*, 3*c*, and 3*d* write a latent image on the charged photosensitive belt 1 with a laser or a light emitted from an LED.

The developing means 4*a*, 4*b*, 4*c*, and 4*d* supply liquid toner, composed of particle toner and a liquid solvent, to the surface of the photosensitive belt 1 and attaches liquid toner onto the latent image formed on the photosensitive belt in the preceding process to make the image visible.

The electro-photographic forming apparatus has four exposure means 3 and four developing means 4. Each developing means supplies yellow, magenta, cyan, and black liquid toner, and each exposure means emits light to form toner images in different colors. The developing means uses liquid toner in different colors to develop and produce a full-color image. It is also possible to provide one exposure means 3 and one developing means 4 to provide a monochrome image forming apparatus.

Next, the liquid toner image on the photosensitive belt 1 is brought to the liquid recovery means 5. Before starting printing, the liquid recovery means 5 moves in the direction indicated by an arrow 101 to come into contact with the photosensitive belt 1. During printing, the liquid recovery means 5 removes only the liquid solvent from the liquid toner to make the developer on the photosensitive belt 1 a particle toner image. In the standby state, the liquid recovery means 5 moves in the direction indicated by an arrow 102 to move away from the photosensitive belt 1.

Temperature control means 59 of the liquid recovery means 5, which controls the temperature, controls the temperature at the point where the drying belt 54 comes into contact with the photosensitive belt 1.

The developer on the photosensitive belt 1 is brought to the transfer/fixing means 6 comprising the transfer roller 6*a* and the fixing roller 6*b*.

The transfer roller 6*a*, which is in contact with the photosensitive belt 1, receives the particle toner included in the developer on the photosensitive belt 1 (transfer). The particle toner included in the developer on the photosensitive belt 1 is the toner that remains on the photosensitive belt 1 even after the photosensitive belt passes through the drying nip between the driving roller and the nip roller 51 which will be described later.

The fixing roller 6*b*, which is in contact with the transfer roller 6*a*, melts the particle toner transferred on to the transfer roller 6*a*. At this time, the melted particle toner is transferred from the transfer roller 6*a* to paper 8 and a printed matter is produced for ejection from the apparatus.

Figure 2:
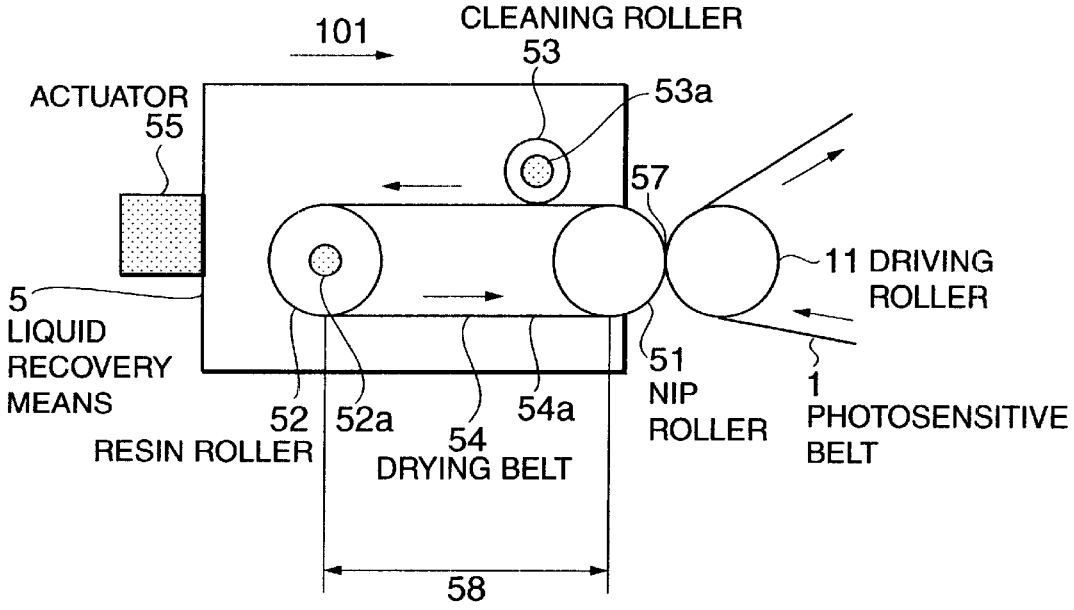
FIG. 2 is a diagram showing the detailed configuration of the liquid recovery means shown in FIG. 1.

Next, the configuration of the liquid recovery means will be described in detail. FIG. 2 is a diagram showing the detailed configuration of the liquid recovery means of the image forming apparatus according to the present invention.

The nip roller 51, provided near the photosensitive belt 1, works with the resin roller 52 to rotate the drying belt 54 that is a drying medium with an absorption layer 54*a*. In addition, a drying nip 57 is formed at a position where the photosensitive belt 1 and the nip roller 51 come in contact each other.

In the drying nip 57, the liquid solvent included in the developer on the photosensitive belt 1 is removed and is absorbed into the absorption layer 54*a* of the drying belt 54.

The resin roller 52 uses the heat of a lamp 52*a*, provided as a first heat source, to heat and dry the liquid solvent absorbed in the absorption layer 54*a* and vaporizes it.

The cleaning roller 53, which is in contact with the drying belt 54, uses the heat of a lamp 53*a* as a second heat source to recover and melt foreign matters included in the particle toner and the developer moved to the absorption layer 54*a*. At the same time, the cleaning roller 53 heats and dries the liquid solvent absorbed in the absorption layer 54*a* and vaporizes it.

The photosensitive belt 1 supported by a driving roller 11 moves in the direction indicated by the arrow. The liquid recovery means 5 comprises the nip roller 51 that is brought into pressure contact with the driving roller 11, the drying belt 54 provided between the photosensitive belt 1 and the nip roller 51, the resin roller 52 working with the nip roller 51 to support the drying belt 54 and containing the first heat source 52*a*, the cleaning roller 53 that is in contact with the drying belt 54, that is located in the downstream of the photosensitive belt 1, and that contains the second heat source 53*a*, a housing 56 containing all those components, and an actuator 55 bringing the nip roller 51 into pressure contact with the driving roller 11 via the housing during printing and releasing the pressure contact between the nip roller 51 and the driving roller 11 to provide a clearance between the photosensitive belt 1 and the drying belt 54 during standby. In the configuration shown in the figure, the resin roller 52 and the cleaning roller 53 are provided as heating rollers containing heat sources for vaporizing the liquid solvent absorbed in the absorption layer 54*a* and the drying belt 54. The first and second heat sources are a lamp and so on.

Next, the operation will be described.

First, the developing units 4*a*, 4*b*, 4*c*, and 4*d* supply liquid toner to the surface of the photosensitive belt 1 to attach the liquid toner to the latent image on the photosensitive belt formed in the preceding process to make the image visible. The developed toner image is transported by the photosensitive belt 1, for example, counterclockwise.

The toner image transported by the photosensitive belt 1 reaches the drying nip 57. At this time, the particle toner contained in the developer on the photosensitive belt 1 is left on the photosensitive belt 1 and is transferred to the transfer roller 6*a*.

The liquid solvent of the developer is absorbed into the absorption layer 54*a*. The foreign matter and particle toner contained in the liquid solvent moved to the absorption layer 54*a* are recovered by the cleaning roller 53.

The cleaning roller 53, resin roller 52, and drying belt 54 are in contact each other. Therefore, the lamp 53*a* in the cleaning roller 53 and the lamp 52*a* in the resin roller 52 heat the drying belt 54 at the position where the belt comes into contact with the cleaning roller 53 and the resin roller 52. These lamps heat and dry the liquid solvent absorbed in the absorption layer 54*a* and vaporize the solvent. After that, the surface of the drying belt 54 is cooled by a cooling part 58, and the drying belt 54 reaches the drying nip 57 again. In this way, the liquid solvent of the developer is recovered.

However, the absorption layer 54*a* on the drying belt 54 differs in characteristics between the print start time and the continuous print time. It is therefore difficult to ensure the long life of the drying belt 54 while maintaining the quality of printing.

At a print start time when the drying belt 54 is dry, the liquid solvent absorption performance is high and a toner image on the photosensitive belt 1 becomes too dry. Therefore, the transfer/fixing means 6 sometimes does not transfer an image from the photosensitive belt 1 to the transfer roller 6*a* satisfactorily. In addition, the drying belt 54, which usually absorbs only the liquid solvent contained in the liquid toner on the photosensitive belt 1, absorbs particle toner images or the foreign matters contained in the liquid toner if its liquid absorption performance is very high. The foreign matters, once absorbed by the drying belt 54, are difficult to be recovered by the cleaning roller 53. The foreign matters built up on the surface of the drying belt 54 degrade the absorption performance of the drying belt 54 and shorten the belt life.

When the image forming apparatus according to the present invention is turned on, the resin roller 52 and the cleaning roller 53 are adjusted to predetermined temperatures by the heat sources contained therein. The cleaning roller 53 has two control temperatures. In the standby state, the cleaning roller 53 is controlled at a first control temperature; during printing, it is controlled at a second temperature. The second temperature is set higher than the first control temperature. When printing is finished, the second control temperature is reset to the first control temperature. Therefore, when power is turned on, the cleaning roller 53 is controlled at the first control temperature. The image forming apparatus becomes ready for printing when the temperature adjustment of other parts (transfer roller and fixing roller contained in the transfer/fixing means) having heat sources is completed.

Starting the print operation causes the developing means 4*a*, 4*b*, 4*c*, and 4*d*, the liquid recovery means 5, and the transfer/fixing means 6 to be brought into pressure-contact with the photosensitive belt 1. Then, the photosensitive belt 1 is driven clockwise in FIG. 1 by the driving roller 11.

The developing means 4 supplies liquid toner in advance before forming a latent image, and the formation of a latent image begins from the moment a predetermined part of the photosensitive belt 1 reaches the position of the first exposure means 3*a*. When printing starts, the control temperature of the cleaning roller 53 changes to the second control temperature to gradually raise the temperature of the cleaning roller 53.

Figure 3:
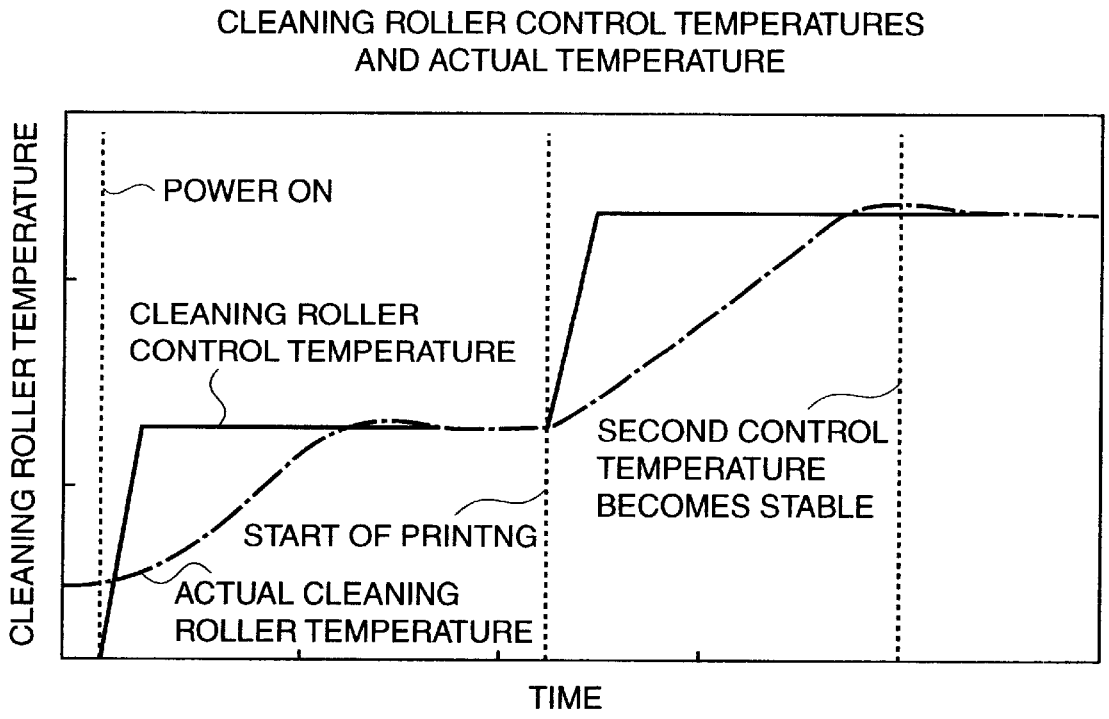
FIG. 3 is a graph showing the relation between cleaning roller control temperatures and actual temperatures.

FIG. 3 is a diagram showing the overview of how the cleaning roller control temperature and the actual roller surface temperature change when the temperature is controlled as described above. Although the control temperature changes in stages, it takes some time until the actual surface temperature rises. The temperature rise rate may be set freely depending upon the heat capacity of the cleaning roller and the output of the heat source that is used.

The two types of temperature may be controlled by the roller layout, either by the resin roller 52 or by the resin roller 52 and the cleaning roller 53.

In addition, when the image forming apparatus according to the present invention starts printing but before the first image is written on the photosensitive belt, the developing means 4, liquid recovery means 5, and transfer/fixing means 6 are each brought into pressure contact with the photosensitive belt 1. Then, the driving roller 11 drives the photosensitive belt 1 clockwise in FIG. 1, the developing means 4 supplies liquid toner, and the formation of a latent image starts when a predetermined part of the photosensitive belt 1 reaches the position of the first exposure means 3. At this time, before the exposure means 3 starts creating a latent image, the drying belt 54 is turned at least one revolution with liquid toner supplied from the developing means.

Because no latent image is formed on the photosensitive belt 1 at this time, the particle toner in the liquid toner is not developed on the photosensitive belt 1 but the liquid solvent in the liquid toner, adhered to the photosensitive belt by surface tension, is transported. This supplies liquid solvent to the drying belt 54 of the liquid recovery means that is in the downstream of the photosensitive belt. The drying belt 54 rotates at least one revolution in this state and, after all part of the drying belt is moistened by the liquid solvent transported by the photosensitive belt, the formation of an image starts at a predetermined position.

When the liquid toner stored in the conventional developing means is used for supplying liquid solvent to the drying belt before printing starts, a very small amount of particle toner or foreign matters in the liquid toner is attached on the photosensitive belt if no image is formed thereon but the amount is not completely zero. Thus, as means for stabilizing the liquid absorption performance before printing starts, the liquid supply means is provided to supply only pure liquid solvent that contains neither particle toner nor foreign matters. The configuration is shown in FIGS. 4 and 5.

Figure 4:
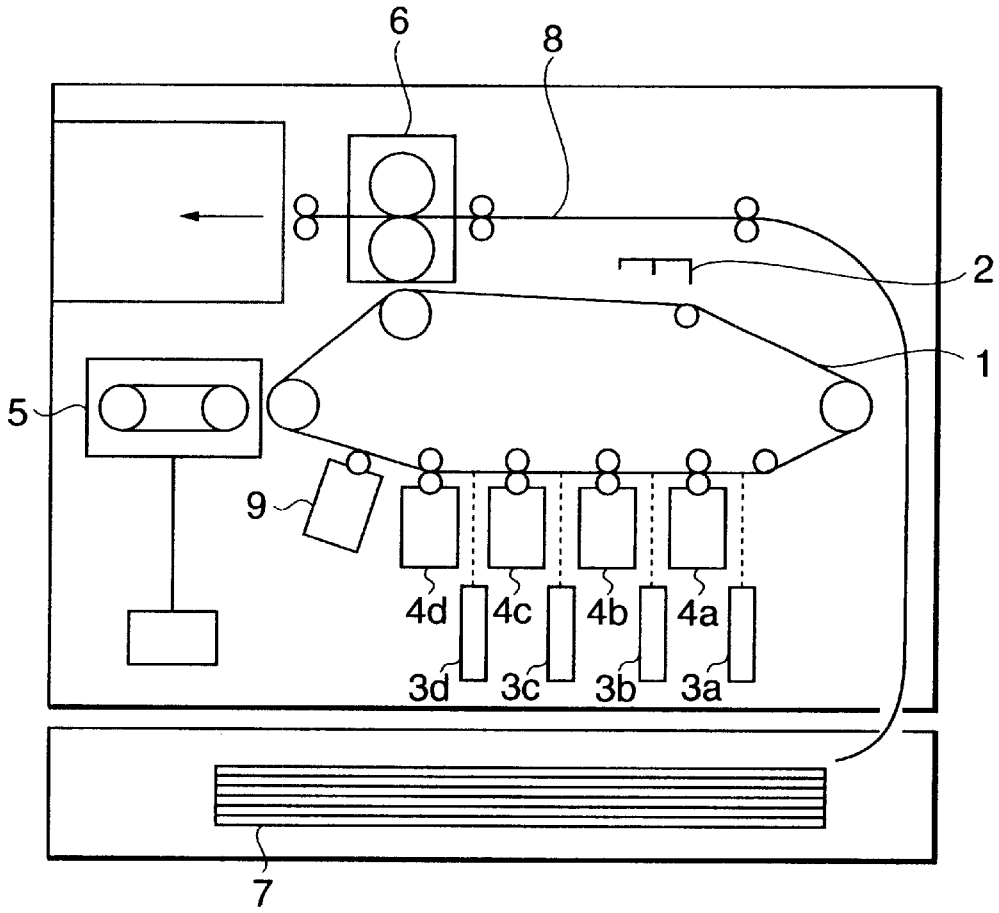
FIG. 4 is a diagram showing the configuration of a second embodiment of the present invention.

FIG. 4 is a diagram showing the configuration of a second embodiment of an image forming apparatus according to the present invention. Liquid supplying means 9, which is provided between the developing means 4*d* and the liquid recovery means 5, is in contact with the photosensitive belt 1. Inside the liquid supplying means 9 is stored liquid solvent that is supplied to the photosensitive belt 1 as necessary.

In this configuration, the liquid supplying means 9, which is in contact with the photosensitive belt 1, is provided between the fourth developing means 4*d* and the liquid recovery means 5. When printing starts, the developing means 4, liquid recovery means 5, and transfer/fixing means 6 are each brought into pressure contact with the photosensitive belt 1, the photosensitive belt 1 is driven by the driving roller 11, liquid toner is supplied from the developing means 4, and the formation of a latent image starts when a predetermined part of the photosensitive belt 1 reaches the position of the first exposure means 3*a*. At this time, before the exposure means 3 starts creating a latent image, the drying belt 54 is turned at least one revolution, with liquid solvent supplied from the liquid supplying means 9 and transported on the photosensitive belt 1, to supply liquid solvent to the drying belt 54. After the drying belt 54 turns one or more revolutions in this state, image formation starts at a predetermined position.

Figure 5:
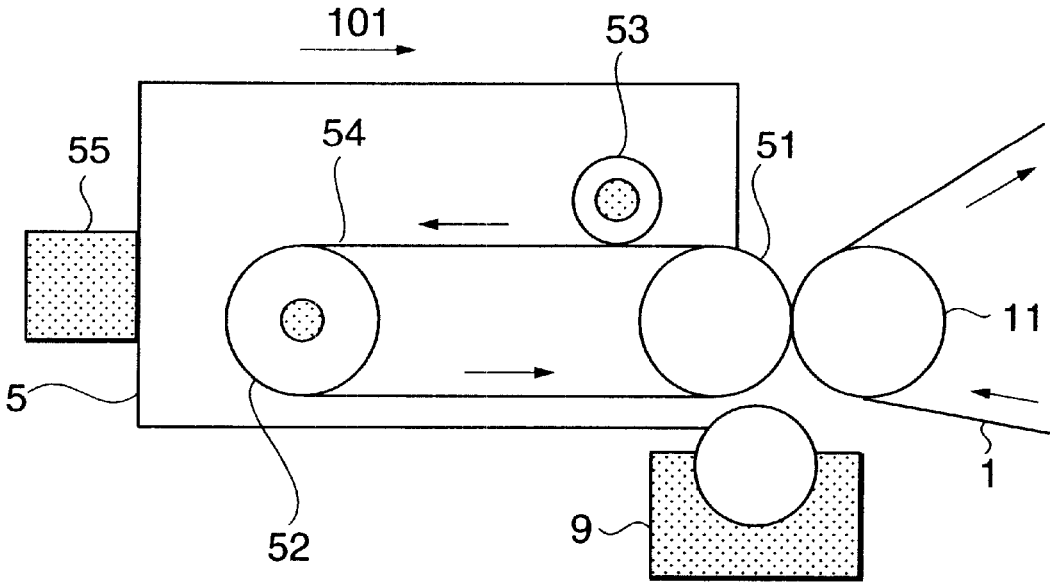
FIG. 5 is a diagram showing the detailed configuration of liquid recovery means in a third embodiment of the present invention.

FIG. 5 is a diagram showing the detailed configuration of liquid recovery means of an image forming apparatus in a third embodiment of the present invention. In this embodiment, the liquid supplying means 9 is in contact with the drying belt 54. The liquid supplying means 9 is in the upstream of the contact point between the drying belt 54 and the photosensitive belt land is in contact with the nip roller 51. This liquid supplying means 9 also contains liquid solvent and supplies it to the drying belt as necessary. Although in contact with the nip roller in this figure, the liquid supplying means may be located anywhere in the upstream of the contact point between the drying belt 54 and the photosensitive belt 1 and from the resin roller 52 to the contact point between the drying belt 54 and the photosensitive belt 1.

In this configuration, the liquid supplying means 9 is located in the liquid recovery means 5 to supply liquid solvent directly to the drying belt 54.

As shown FIGS. 4 and 5, the liquid supplying means is provided separately from the developing means. The liquid supplying means supplies liquid solvent to the drying belt to prevent the particle toner or foreign matters from attaching on the drying belt, thus prolonging the life of the drying belt.

Figure 6:
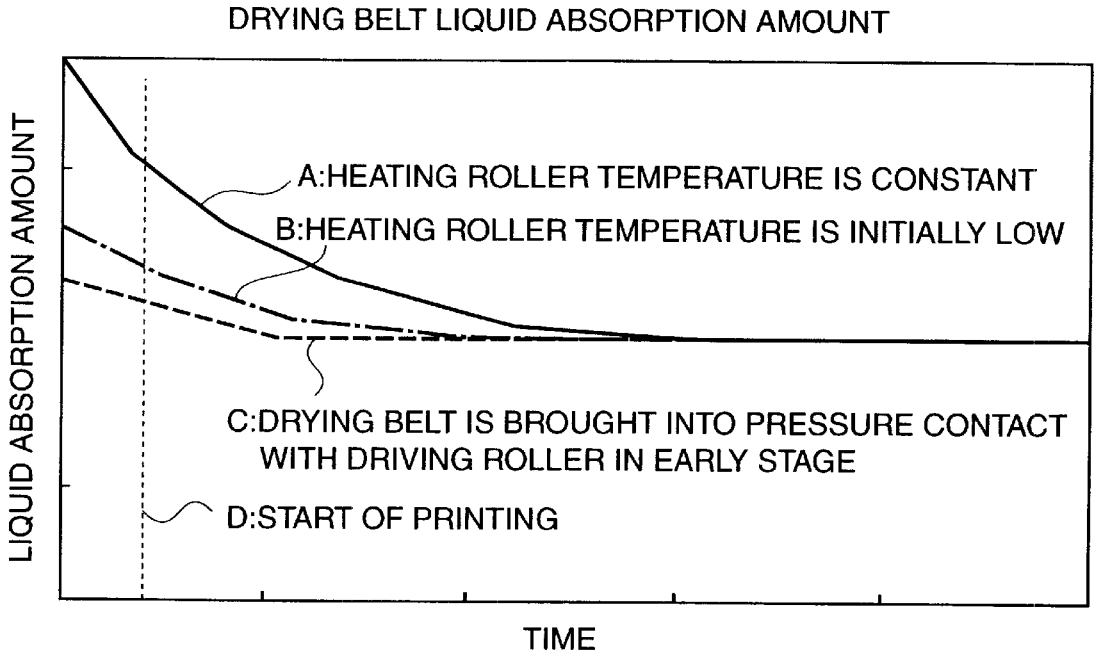
FIG. 6 is a graph showing a change in the liquid absorption amount of a drying belt with respect to elapsed times.

FIG. 6 is a graph showing the liquid solvent absorption performance of the drying belt. The horizontal axis indicates the time elapsed from the moment the developing means supplies liquid ink without forming a latent image on the photosensitive belt. The vertical axis indicates the liquid solvent absorption performance of the drying belt.

Graph A shows the liquid absorption performance of the drying belt of a conventional image forming apparatus that keeps the cleaning roller constantly at a high temperature. In the initial stage during which the apparatus starts supplying liquid solvent to the drying belt, the temperature of the heating roller is at a constant temperature as if the apparatus was printing. The drying belt is therefore dry and shows a very high liquid absorption performance as indicated by graph A. The liquid absorption performance, also dependent on the temperature of the drying belt, becomes high as the temperature gets higher. After a predetermined time elapses after the start of liquid absorption, the liquid absorption performance becomes stable at a point where the amount of liquid absorption of the drying belt equals the amount of the liquid solvent that vaporizes from the surface of the drying belt by the heat of the resin roller and the cleaning roller. When printing starts at time D with the cleaning roller temperature constantly kept high, the drying belt absorbs too much liquid solvent. This over-dries a toner image on the photosensitive belt and degrades the image quality.

On the other hand, graph B shows the liquid absorption performance of the drying belt of the image forming apparatus according to the present invention that initially keeps the cleaning roller temperature low and raises the temperature when printing starts. As shown in graph B, the apparatus keeps the cleaning roller temperature low when printing starts in order to initially lower the liquid solvent absorption performance of the drying belt. This prevents over-absorption and minimizes image quality degradation. On the other hand, the first control temperature, if applied during continuous printing, causes the amount of liquid supplied from the photosensitive belt to the drying belt to exceed the amount of evaporation from the drying belt. This gives too much liquid solvent to the toner image on the photosensitive belt and, when an image is transferred from the photosensitive belt to the transfer/fixing means, degrades the image quality. Therefore, the second control temperature is applied to the cleaning roller to keep constant the liquid absorption amount and the evaporation amount of the drying belt to produce constantly stable images.

In addition, supplying liquid solvent to the drying belt before printing starts, as illustrated in graph C, further improves the liquid absorption performance of the drying belt. In this case, the difference between the liquid absorption performance of the drying belt at print start time and that of the drying belt during printing is so small that the apparatus produces stable, good-quality images.

What is claimed is:

1. An electro-photographic image forming apparatus, comprising:

a photosensitive belt;

electrostatic latent image former for forming an electrostatic latent image on said photosensitive belt;

a developer for developing the electrostatic latent image with a liquid toner composed of a particle toner and a liquid solvent;

liquid recovery device for recovering only the liquid solvent from a liquid toner image developed on the photosensitive belt; and transfer/fixing device for taking a dried toner image from the photosensitive belt for transferring the toner image to, and fixing the toner image on, paper, wherein said liquid recovery device comprises:

an absorption device that is brought into pressure contact with the photosensitive belt and that has an absorption layer absorbing the liquid solvent into a surface thereof;

a heat source that vaporizes the liquid solvent absorbed in the absorption layer of said absorption structure; and a temperature controller for controlling a temperature of said heat source with a temperature control method that differentiates between a standby time and a print time, wherein said liquid recovery device further comprises a moistener that moistens said absorption device with the liquid solvent before a first image is written on said photosensitive belt.

2. The electro-photographic image forming apparatus according to claim 1, wherein said moistener has a liquid supply that is separate from said developer.

3. The electro-photographic image forming apparatus according to claim 1, wherein said liquid recovery device has an actuator that separates said absorption device from said photosensitive belt at the standby time and that brings said absorption device into contact with said photosensitive belt and at the print time.

4. An electro-photographic image forming method, comprising the steps of:

forming an electrostatic latent image on a photosensitive belt;

developing the electrostatic latent image on the photosensitive belt with a liquid toner composed of a particle toner and a liquid solvent;

recovering only the liquid solvent from a liquid toner image developed on the photosensitive belt;

taking a dried toner image from the photosensitive belt for transferring the toner image to paper;

fixing the toner image on the paper; and controlling a temperature of a heat source with a temperature control method that differentiates between a standby time and a print time, said heat source vaporizing a liquid solvent absorbed into an absorption device that is brought into pressure contact with said photosensitive belt, further comprising the step of moistening all of said absorption device with the liquid solvent before a first image is written on said photosensitive belt.

5. The electro-photographic image forming method according to claim 4, further comprising the steps of:

separating said absorption device from said photosensitive belt at the standby time; and bringing said absorption device into contact with said photosensitive belt before starting printing.

* * * * *